US006820281B2

(12) United States Patent
Mariland et al.

(10) Patent No.: US 6,820,281 B2
(45) Date of Patent: Nov. 23, 2004

(54) EASY ACCESS TOWEL COMPARTMENT

(76) Inventors: Glenn W. Mariland, 10918 Lamprone St., Las Vegas, NV (US) 89141; Ronald Eugene Brown, P.O. Box 14276, Las Vegas, NV (US) 89114-4276

( * ) Notice: Subject to any disclaimer, the term of this patent is extended or adjusted under 35 U.S.C. 154(b) by 0 days.

(21) Appl. No.: 10/115,512

(22) Filed: Apr. 2, 2002

(65) Prior Publication Data

US 2003/0182714 A1 Oct. 2, 2003

(51) Int. Cl.[7] ..... A41D 13/00
(52) U.S. Cl. ..... 2/115; 2/69; 2/247
(58) Field of Search ..... 2/113–115, 69, 2/69.5, 227, 228, 79, 80, 83, 85, 93, 94, 95, 46, 50, 51, 59, 60, 104–106, 102, 108, 247–252, 125; 224/932; 15/209.1, 208, 210.1

(56) References Cited

U.S. PATENT DOCUMENTS

| | | | | | |
|---|---|---|---|---|---|
| 3,428,962 | A | * | 2/1969 | Slimovitz | 2/48 |
| 3,537,108 | A | * | 11/1970 | Daniels | 2/247 |
| 4,277,848 | A | | 7/1981 | Boehland | |
| 4,536,889 | A | | 8/1985 | Taylor et al. | |
| 4,710,981 | A | | 12/1987 | Sanchez | |
| 4,768,236 | A | | 9/1988 | Klob | |
| 4,771,478 | A | * | 9/1988 | Bisagno et al. | 2/69 |
| 4,924,613 | A | | 5/1990 | Levin | |
| 4,977,626 | A | | 12/1990 | Smith | |
| 4,987,610 | A | * | 1/1991 | Hunt | 2/46 |
| 4,999,848 | A | * | 3/1991 | Oney | 2/115 |
| 5,014,360 | A | * | 5/1991 | Smith et al. | 2/115 |
| 5,029,343 | A | | 7/1991 | McIntyre | |
| 5,075,901 | A | | 12/1991 | Vollrath | |
| 5,343,565 | A | * | 9/1994 | Berni | 2/79 |
| 5,379,461 | A | * | 1/1995 | Wilmers | 2/115 |
| 5,454,119 | A | * | 10/1995 | Thomm | 2/114 |
| 5,640,715 | A | * | 6/1997 | Adams | 2/46 |
| 5,794,267 | A | * | 8/1998 | Wallace | 2/227 |
| 5,813,051 | A | * | 9/1998 | Counter | 2/69 |
| 5,864,878 | A | * | 2/1999 | Mashrick | 2/46 |
| 5,960,476 | A | | 10/1999 | Danzy | |

FOREIGN PATENT DOCUMENTS

| | | | |
|---|---|---|---|
| EP | 1050297 | A2 | 11/2000 |
| GB | 2307843 | A | 6/1997 |

* cited by examiner

*Primary Examiner*—Gloria M. Hale
(74) *Attorney, Agent, or Firm*—Rob L. Phillips; Quirk & Tratos

(57) ABSTRACT

The present invention relates to a compartment for holding a towel. Said compartment is fabricated of a rectangular piece of material having a first section and a second section. The first section is permanently attached to an article of clothing and the second section acts as a flap. VELCRO® removably attaches the second section to the first section forming the compartment therebetween. A towel is removably attached to the first section of the compartment by VELCRO® and/or an elastic band. Towels are always handy for cleaning up cooking messes, wiping perspiration off one's brow, washing a babies face. etc. The compartment of the present invention provides a towel for easy and immediate access under any conditions. Moreover, the towel is generally concealed eliminating clutter and unsightliness. The compartment is ideal for T-shirts, sweatshirts, work-outgear, cooking and painting aprons and articles of clothing used in proximity of infants and children.

14 Claims, 2 Drawing Sheets

EASY ACCESS TOWEL COMPARTMENT

FIELD OF INVENTION

This invention is designed to provide users quick and easy access to a towel for wiping perspiration, collecting spills, cleaning furniture and completing an unlimited number of tasks commonly associated with towel usage. More particularly, a compartment, in the form of a pocket, is positioned on an article of clothing. Said compartment is easily opened to allow a user immediate access to a towel.

DESCRIPTION OF THE PRIOR ART

Towels have unlimited uses, including use as perspiration removers, spill collectors, cleaning devices, baby wipers, etc., but are routinely unavailable or inconveniently located when needed. For example, towels are ideal for wiping perspiration during a run or other exercise routines. However, a towel is easily misplaced during an exercise regiment requiring an individual to move from one weight machine to another. Similarly, during an outdoor run there is no real convenient place for a towel. Another example, relates to the kitchen and cooking. In may cases, kitchen towels are stored out of sight (e.g. in a drawer or cabinet) to keep the kitchen neat in appearance. Therefore, when one requires a towel to wipe their hands of food items, the individual is required to soil a drawer or cabinet handle by opening the same with their unclean hands. Failure to disinfect the handle, once it is soiled, is both unsanitary and unsightly. Similarly, clean towels are useful for wiping a babies face thereby keeping clean the parents' clothing or wiping a child's wound to prevent infection.

While prior art patents have sought to make towels, or towel-like articles, more readily available to a user, none of the patents have utilized the unique compartment described herein.

U.S. Pat. 4,768,236 (the '236 Patent) to Klob discloses a detachable toweling means. The '236 Patent describes a toweling means attached to a pair of shorts by means of Velcro®. Unless the toweling means matches the shorts, the combination is going to be unsightly, especially once the toweling means is soiled with perspiration and dirt. Additionally, the VELCRO® portions fixed to the toweling means can be damaging to one's face if the attachment side of the toweling means is accidentally used to wipe away perspiration.

U.S. Pat. No. 4,771,478 (the '478 patent) to Bisagno, et al., discloses a combination towel and shorts. The '478 patent suffers from several shortcomings, namely unsightliness and inconvenience. Moreover, a user is required to wear the shorts since the attachment means is located thereon.

U.S. Pat. No. 5,029,343 (the '343 patent) to McIntyre describes a towel-like appendage attached to a shirt. According to the specification, the towel-like appendage is preferably attached at one of its end proximate the neck opening on the back of a shirt. As with the '236 and '478 patents, the towel-like appendage is unsightly. In addition, the towel-like appendage can interfere with a users activities if said appendage flips over a user's shoulder to become re-positioned proximate a user's chest area. Further, the free-swinging appendage will cause many users discomfort.

U.S. Pat. No. 5,075,901 (the '901 patent) to Vollrath discloses an athletic shirt-towel assembly. The '901 patent is directed to a shirt fabricated of non-absorbent synthetic material having an absorbent material incorporated near a neckline of the shirt. Besides being unsightly (i.e. dirt openly deposited on the shirt) the assembly having a towel-like surface in contact with a user's skin may be uncomfortable to many users.

Applicant's invention permits a user to quickly and easily access and store a towel for any use. The compartment of the present invention can be placed at any location on any article of clothing, including an apron, shirt, smock, scrubs, etc. Moreover, the compartment may be fabricated of the same material, in the same color, of the article of clothing it is affixed. In a second embodiment, the towel is elastically connected to the article of clothing insuring the towel is immediately placed back into the compartment once it has been used.

SUMMARY OF THE INVENTION

An object of the present invention is to provide quick and easy access to a towel.

Another object of the present invention is to avoid the unsightliness of an exposed towel on one's body.

Another object of the present invention is to provide a compartment for use with any article of clothing.

A further object is to provide any easy access towel physically connected to the compartment to facilitate the immediate return of the towel to the compartment.

Accordingly, a compartment comprises preferably a single rectangular piece of material having a first section fixed to an article of clothing and a second section adjustably attached to said fixed section of material. Preferably, the second section is attached to the fixed section by means of VELCRO® placed on one or more edges of an outer surface of the fixed section and one or more corresponding edges of an inner surface of the second section thereby forming a pocket for containing a towel.

In practice, the second section acts as a flap along a common fold line with the fixed section. In this manner, the compartment can be fabricated to open in any direction (e.g. from left to right, right to left, top to bottom, bottom to top).

In another embodiment the towel is removably attached to a section of the compartment for insuring the towel is, after use, immediately placed back into the compartment. The attachment prevents the towel from being misplaced by a user prior to returning the towel to its intended location within the compartment.

The positioning of the compartment, as well as the articles of clothing able to utilize the compartment, is unlimited. The positioning may be based on the article of clothing chosen. For example, a small towel for wiping perspiration from one's brow may be well-positioned on a sleeve of a long-sleeved shirt for easy access during the perspiration-causing activity. However, a compartment for use with an apron may be positioned more aptly near the chest area of the user.

Other objects, features, and advantages of the invention will become apparent to those skilled in the art upon consideration of the following detailed description of the preferred embodiments thereof as illustrated in the accompanying drawings.

DESCRIPTION OF THE EMBODIMENTS

Figure 1:
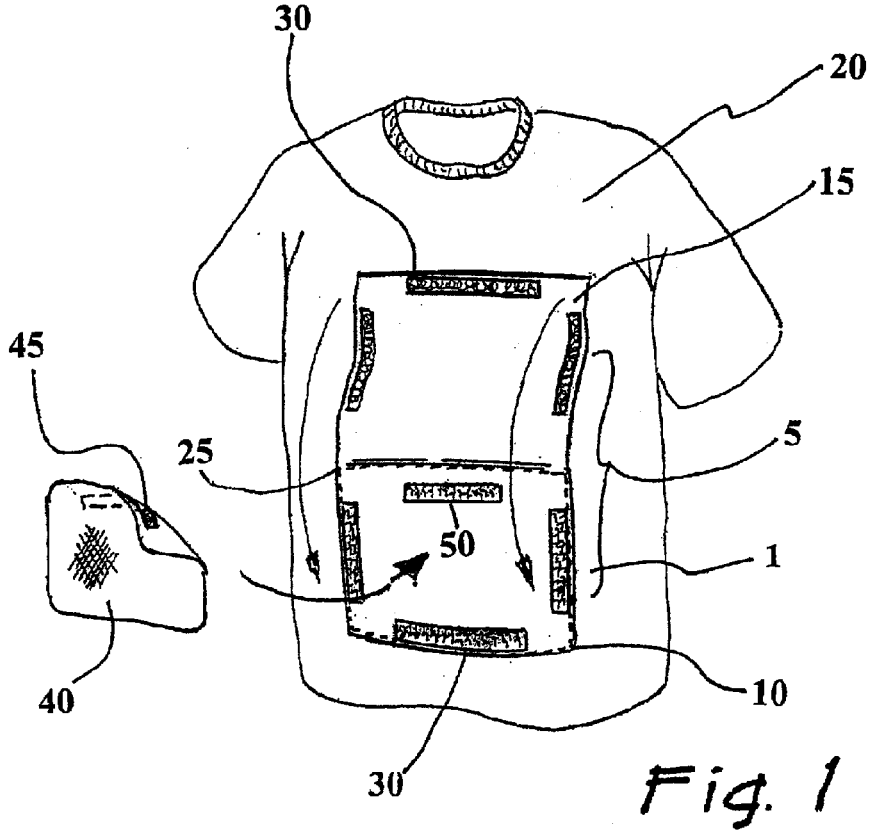
FIG. 1 is a front view of the present invention, while open, implemented on a front surface of a T-shirt.
Figure 2:
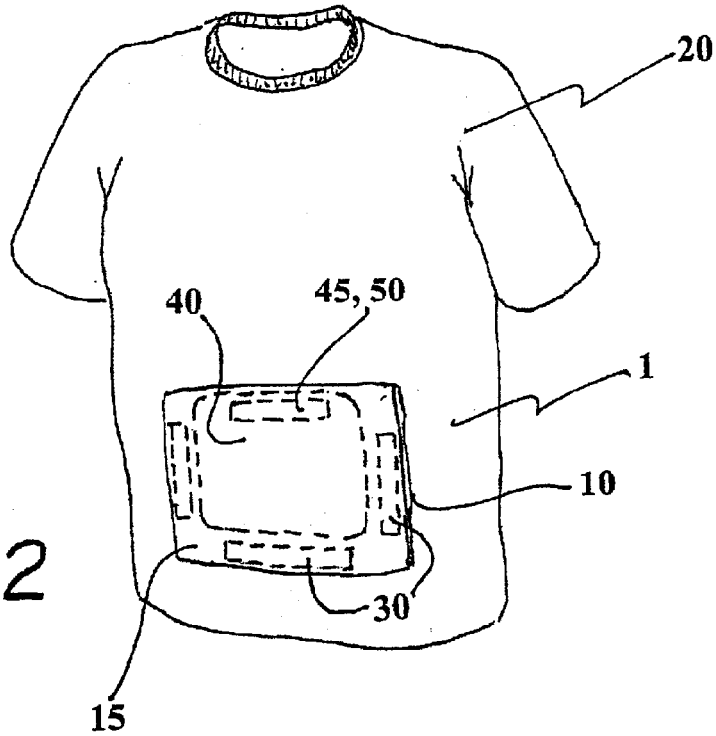
FIG. 2 is a front view of the present invention, while closed, implemented on a front surface of a T-shirt.

Reference is now made to the figures wherein like parts are referred to by like numerals throughout. Referring to FIGS. 1 and 2, the compartment generally designated by the numeral 1 is fabricated with a single rectangular piece of material 5. The material can be of any type but is preferably flexible, durable and water-proof in some instances. As illustrated in FIG. 1, the piece of material 5 includes two sections 10, 15 of generally equal size. A first section 10 is fixed to a T-shirt 20 and a second section 15 forms the closed compartment 1 when folded along line 25 to connect with said first section 10. The first section 10 is preferably sewn to the T-shirt 20 but may be attached by any available means. The material 5 may be waterproof to prevent the contents, namely a towel 40, of the compartment 1 from becoming moist or wet during exercise or other perspiration-causing activities.

The connection between the first section 10 and the second section 15 is facilitated by hook and loop fasteners 30 or the like. Preferably, VELCRO® is the hook and loop fastening material utilized. In this manner, the second section 15 operates like a detachable flap along fold line 25.

The first section 10 and the second section 15 each include a plurality of corresponding VELCRO® members 30 affixed thereto. VELCRO® provides a user easy access to the contents of the compartment 1, namely a towel 40. Preferably, the towel 40 also includes a VELCRO® member 45 affixed thereto and corresponding to a VELCRO® member 50 affixed to the first section 10. The towel 40 is therefore detachably attached to the first section 10 of the compartment 1.

In practice, a user simply detaches the second section 15 from the first section 10 and removes the towel 40 by disconnecting VELCRO® member 45 from VELCRO® member 50. Once finished, the user attaches the two VELCRO® members 45 and 50 to one another and folds the second section 15 to re-attach with the first section 10. While it is shown that the second section 16 folds from top to bottom, the configuration of the compartment 1 may be such that the second section 15 opens and closes from left to right, right to left or bottom to top. In other words, the fold line 25 may be configured along any common edge between the first section 10 and the second section 15. Moreover, the compartment 1 may be placed anywhere on the T-shirt, or other article of clothing, providing it is within comfortable reach.

Figure 3:
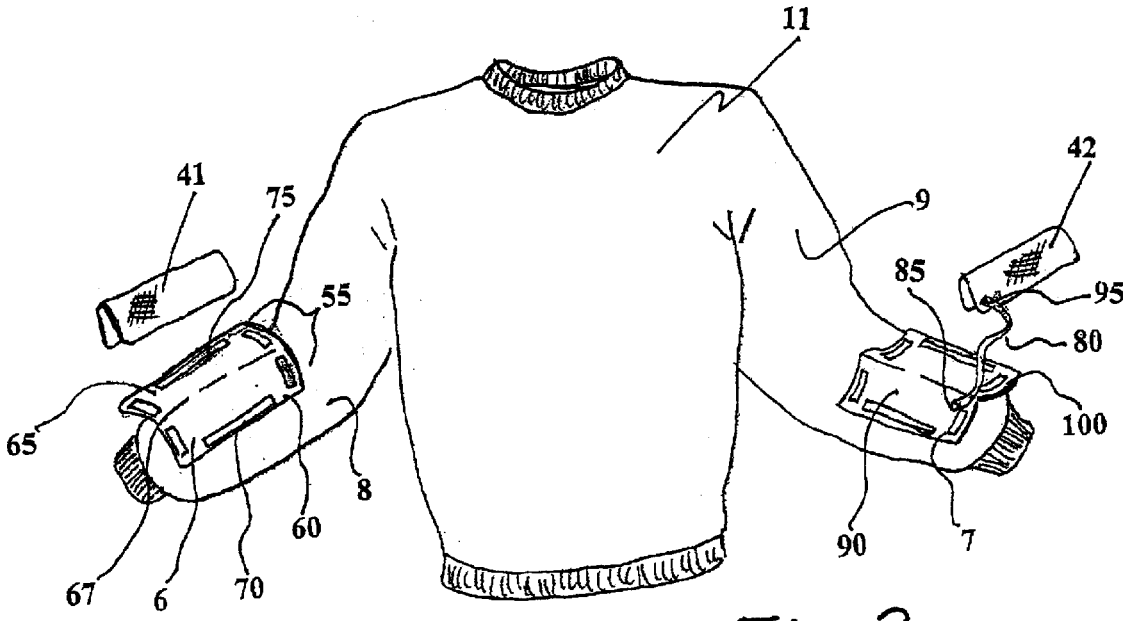
FIG. 3 is a perspective view of the present invention, while closed, implemented on both sleeves of a long-sleeved sweatshirt with one implementation including means for attaching a towel to a portion of the compartment or article of clothing.

Now referring to FIG. 3, compartments 6 and 7 are illustrated on both sleeves 8, 9 of a sweatshirt 11. Again, towels 41, 42 are contained within the compartments 6, 7 respectively for easy access and removal. The compartment 6 shown on sleeve 8 is configured identically to the compartment 1 shown in FIGS. 1 and 2. Accordingly, a rectangular piece of material 55 includes a first section 60 fixed to the sleeve 8 and a second section 65 acting as a flap along fold line 67. VELCRO® members 70 on the first section 60 and corresponding VELCRO® members 75 on the second section 65 removably attach the two sections 60, 65.

A second compartment 7 shown on sleeve 9 utilizes an elastic band 80 connected at a first end 85 to a first section 90 of the compartment 7 and at a second end 95 to a towel 42. In this embodiment, there is no opportunity for the towel 42 to be misplaced prior to returning the towel 42 to the compartment 7. The connection means is not limited to elastic bands and can be any means available. Moreover, the first end 85 can be attached to a second section 100 of the compartment 7 or directly to the sweatshirt 11.

Depending on the size of the compartments 6, 7 the size of the towels 41, 42 may need to be smaller, to fit within the compartments 6, 7 than the towel 40 contained within compartment 1 of FIGS. 1 and 2. Ordinarily, if only one sleeve compartment is attached to a shirt, it will be placed on the sleeve opposite a user's strong arm to facilitate the removal and replacement of a towel.

Figure 4:
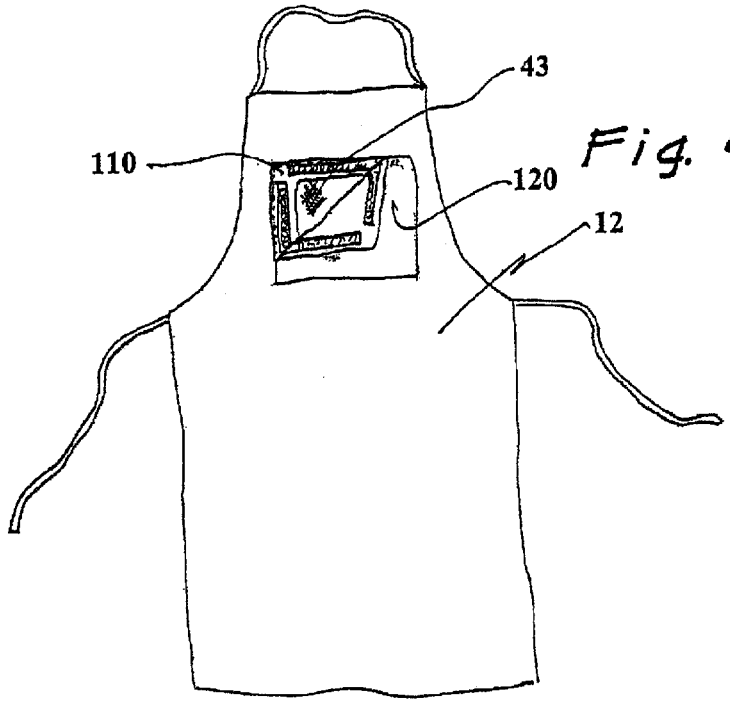
FIG. 4 is a front view of the present invention, while opened, implemented on a front surface of an apron.

FIG. 4 illustrates the present invention implemented on an apron 12. Again, a first section 110 is connected to the apron 12 and a second section 120 acts as a flap to close thereby forming a compartment. Towel 43 is then accessible when needed during the cooking process.

Although the invention has been described in detail with reference to a preferred embodiment, additional variations and modifications exist within the scope and spirit of the invention as described and defined in the following claims.

We claim:

1. An article of clothing in combination with a towel including:

a piece of material having a first section and a second section, said first section being permanently attached to said article of clothing, said second section acting as a flap; and means for removably attaching said second section to said first section forming a compartment therebetween, said compartment completely concealing the towel, said towel being removably attached to the piece of material such that said towel may be removed from said compartment for use while remaining attached within said compartment during non-use.

2. The combination of claim 1 wherein said towel is removably attached to the first section of said piece of material.

3. The combination of claim 1 wherein said towel is removably attached to the second section of said piece of material.

4. The combination of claim 1 wherein said means for removably attaching said second section to said first section is hook and loop fasteners.

5. The combination of claim 1 wherein said towel is removably attached to said piece of material by means of hook and loop fasteners.

6. The combination of claim 1 wherein said towel is removably attached to said piece of material by means of an elastic band.

7. The combination of claim 1 wherein at least said first section is fabricated of a waterproof material.

8. An article of clothing comprising:

a compartment for holding a towel, said compartment fabricated of a piece of material having a first section and a second section, said first section being permanently attached to said article of clothing, said second section acting as a flap; and means for removably attaching said second section to said first section forming said compartment therebetween, said compartment completely concealing the towel, said towel being removably attached to the piece of material such that said towel may be removed from said compartment for use while remaining attached within said compartment during non-use.

9. The article of clothing of claim 8 wherein said towel is removably attached to the first section of said piece of material.

10. The article of clothing of claim 8 wherein said towel is removably attached to the second section of said piece of material.

11. The article of clothing of claim 8 wherein said means for removably attaching said second section to said first section is hook and loop fasteners.

12. The article of clothing of claim 8 wherein said towel is removably attached to said piece of material by means of hook and loop fasteners.

13. The article of clothing of claim 8 wherein said towel is removably attached to said piece of material by means of an elastic band.

14. The article of clothing of claim 8 wherein at least said first section is fabricated of a waterproof material.

* * * * *